US005749815A

United States Patent [19]

Lipps

[11] Patent Number: 5,749,815

[45] Date of Patent: May 12, 1998

[54] PORTABLE EXERCISE DEVICE

[76] Inventor: John D. Lipps, 1514 Ridgecrest Dr., Kent, Ohio 44240

[21] Appl. No.: 865,728

[22] Filed: May 30, 1997

[51] Int. Cl.[6] ..... A63B 21/02

[52] U.S. Cl. ..... 482/122; 482/126; 482/121; 482/132

[58] Field of Search ..... 482/121, 122, 482/124, 126, 129, 130, 128, 132

[56] References Cited

U.S. PATENT DOCUMENTS

| | | | |
|---|---|---|---|
| 1,984,165 | 12/1934 | Tolchin | 482/132 |
| 2,129,262 | 9/1938 | Cole | 482/132 |
| 3,589,720 | 6/1971 | Agamian | 482/132 |
| 4,517,966 | 5/1985 | Othegraven . | |
| 5,160,304 | 11/1992 | Van Der Hoevan . | |
| 5,232,425 | 8/1993 | Miller . | |
| 5,651,755 | 7/1997 | Chen | 482/126 |

*Primary Examiner*—Lynne A. Reichard
*Attorney, Agent, or Firm*—Donald R. Bahr

[57] ABSTRACT

This invention is concerned with a portable exercise device which can readily be broken down into its component parts for storage. Regardless of its portability the portable exercise device is capable of providing the user with a good workout. This portable exercise device has a two segment main body section which can be readily assembled and disassembled. When assembled the main body section incorporates an elongated groove into which is positioned a limb. One end of the main body section further incorporates a U shaped groove into which is positioned an elastic band. The ends of the elastic band are looped. These looped ends are positioned around the limb on opposite sides of the main body section. The other end of the main body section is fitted with a cushion. In operation the user positions the cushion of the portable exercise device against his midriff. The uses then grips the opposite ends of the limb with both hands and draws the limb towards his midriff. The movement of the limb in the groove of the main body section is restrained by the elastic band. The movement of the limb against the tension of the elastic band provides exercise to the user. In the preferred embodiment the main body section and the limb are formed from a polymeric material. Further in the preferred embodiment the segmented parts of the main body section are secured to each other by a tongue and groove arrangement.

19 Claims, 2 Drawing Sheets

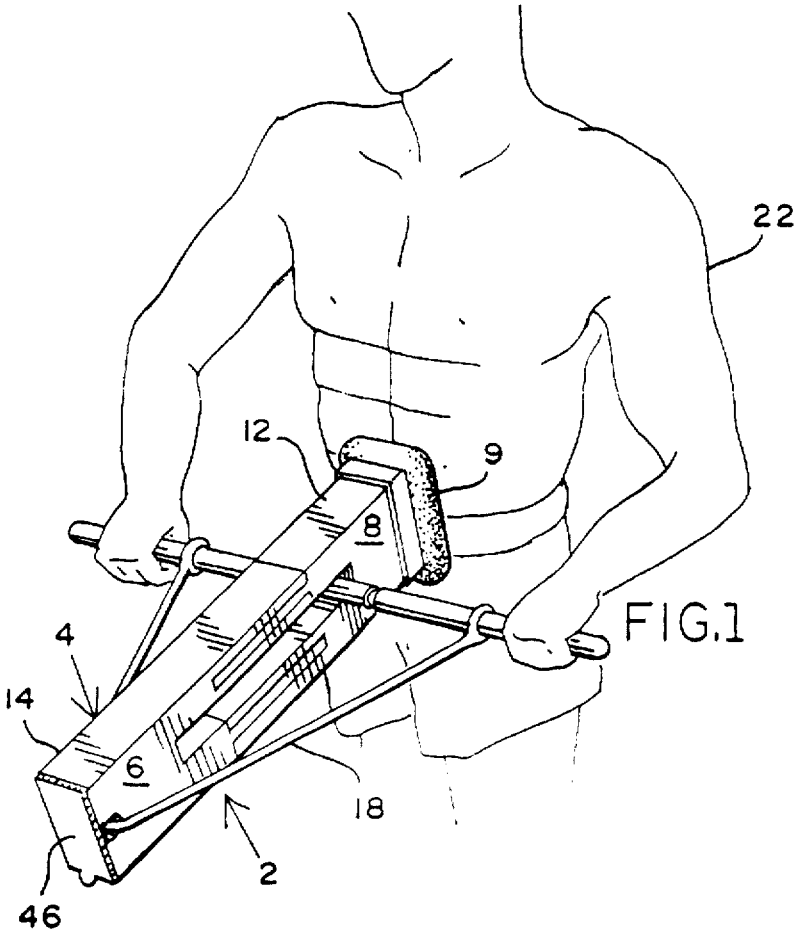
FIG.1
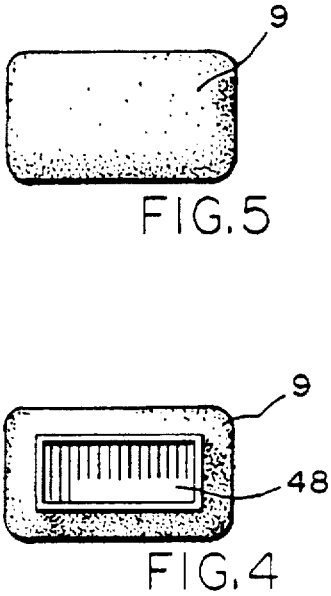
FIG.5
FIG.4
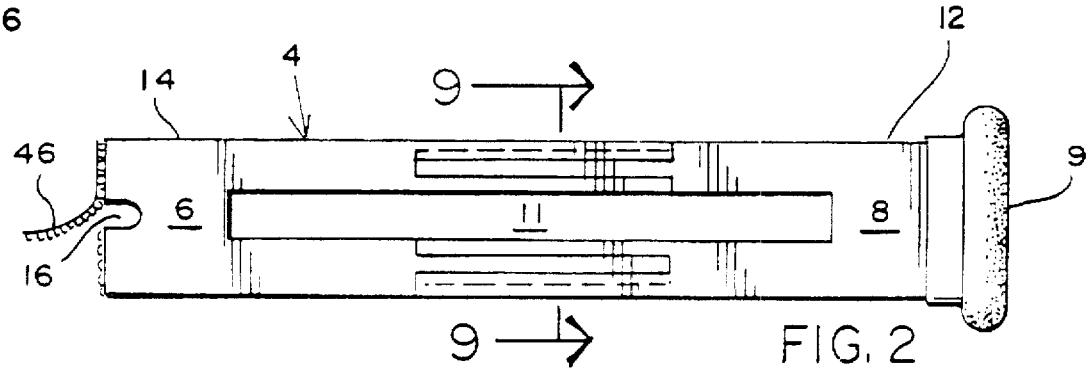
FIG. 2
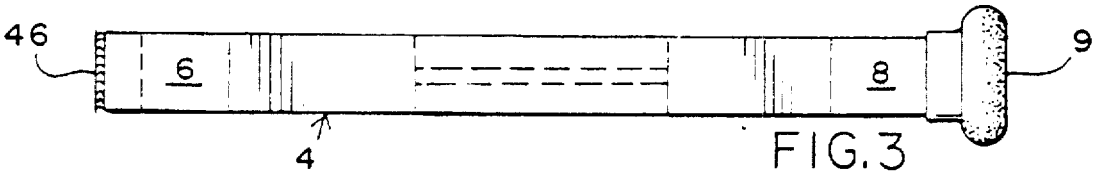
FIG.3

PORTABLE EXERCISE DEVICE

FIELD OF THE INVENTION

This invention is concerned with portable exercise devices which can be used for personal exercise in out of the way places. Exercise devices are of two principal types, these being the large bulky type and the portable type. This invention is concerned with the portable type of device. Portable exercise devices have become very popular in recent years as the general population has become more mobile and more health conscious. The portable exercise device of this invention when assembled, is capable of providing an individual with a good workout in a wide variety of environments Further, the portable exercise device of this invention is advantageous in that it can be quickly and easily assembled and disassembled without tools by the user. In contrast, the large bulky exercise devices as mentioned above are bulky and heavy and hence can only be used in a fixed place.

The subject invention is useful for people who travel extensively for example businessmen. These travelers often find themselves in out of the way places in hotel rooms with no way to exercise. Hence there is a need for a portable exercise device which can be readily disassembled and stored in a suitcase. Further there is a need for a portable exercise device which will allow a user to work out most of the bodies principal muscle groups. The portable exercise device of this invention satisfies these needs in that it has only five parts which can be readily assembled and disassembled and yet in use the device is capable of providing a work out for every muscle area of the human body.

Accordingly, it is an object of this invention to provide a portable device which will provide a user with a beneficial work out.

It is a further object of this invention to provide an exercise device which can be readily disassembled and stored.

Likewise, it is an object of this invention to provide a portable exercise device which is light weight and which can be readily packed for travel.

It is also an object of this invention to provide a portable exercise device wherein the individual components can be easily replaced.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings,

SUMMARY OF THE INVENTION

The present invention is defined by the appended claims with the specific preferred embodiment shown in the attached drawings. For the purpose of summarizing the invention, the invention may be defined as a portable exercise device having a small number of parts which can be readily assembled and disassembled. The component parts of the main body section of the exercise device of this invention are attached to each other using a tongue and groove arrangement. The exercise device of this invention is of such a structure that it can be readily converted from a set up stance to a disassembled stance. The ability to convert the device form from a set up stance to a disassembled stance is very useful, as in the disassemble stance the portable exercise device can be readily stored for travel with the other personal effects of the user.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art, that the conception and the specific embodiment disclosed herein may be readily utilized as a basis for modifying or designing other apparatus for carrying out the same purposes of the present invention. It should also be realized by those skilled in the art that such equivalent apparatus do not depart from the spirit and scope of the invention as set forth in the appended claims.

DESCRIPTION OF THE DRAWINGS

FIG. 1 is a perspective view showing the portable exercise device assembled and in use, FIG. 2 is a top plan view, showing the main body portion of the exercise device of this invention.

FIG. 3 is a side view, showing the main body portion of this invention.

FIG. 4 is an end view, showing means whereby the cushion is attached to the main body portion.

FIG. 5 is an end view showing that portion of the cushion which engages the body of the user.

DESCRIPTION OF THE PREFERRED EMBODIMENT

Figure 7:
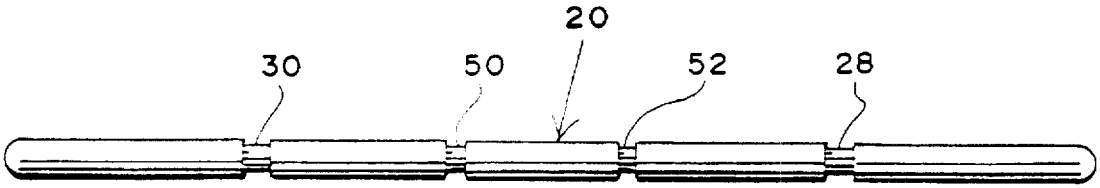
FIG. 7 is a side view, showing the limb of the exercise device of this invention.

The subject invention relates to a portable exercise device which can be readily disassembled into its component parts for convenient storage. The subject portable exercise device comprises a two segment main body section, a cushion, a limb and an elastic band. After the assembly of the main body section, the limb is positioned in a groove which is integral with the main body section and the elastic band is attached to the one end of the main body section and to the opposing sides of the limb.. The cushion is attached to the other end of the main body section. The cushion dispenses the force of the elastic band over an acceptable area of the users body. The limb rides in a slot which is integral with the main body section. The travel of the limb is controlled by the length of this slot.

Referring to FIG. 1, it can be seen that the portable exercise device 2 of this invention comprises a main body section 4 which is in turn formed from two segments 6 and 8. A cushion member 9 is attached to one terminal end 12 of main body section 4. The opposite terminal end 14 of main body section 4 incorporates a groove 16 into which is placed an elastic band 18 the ends of elastic band 18 are placed over opposite sides of limb 10.

Once assembled as is illustrated in FIG. 1 a user 22 positions cushion member 9 against his midriff and draws limb 20 toward himself. This movement causes elastic band 18 to stretch thereby providing resistance to the movement of limb 10 towards user 22. This resistance in turn provides exercise for user 22.

Figure 8:
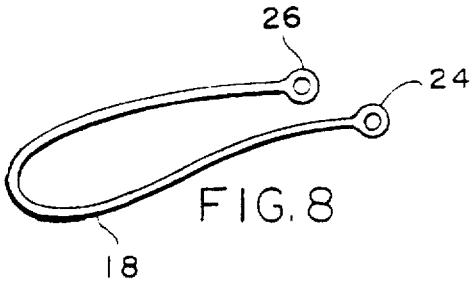
FIG. 8 is a perspective top view of the elastic band as used in exercise device of this invention.

As can be seen in FIG. 8 the ends of elastic band 18 are formed into loops 24 and 26 which are positioned over opposite sides of limb 10. Limb 19 further incorporates a pair of grooves 28 and 30 into which are positioned loops 24 and 26. Grooves 28 and 30 help maintain the position of loops 24 and 26 and hence the position of elastic band 18 on limb 10.

Figure 6:
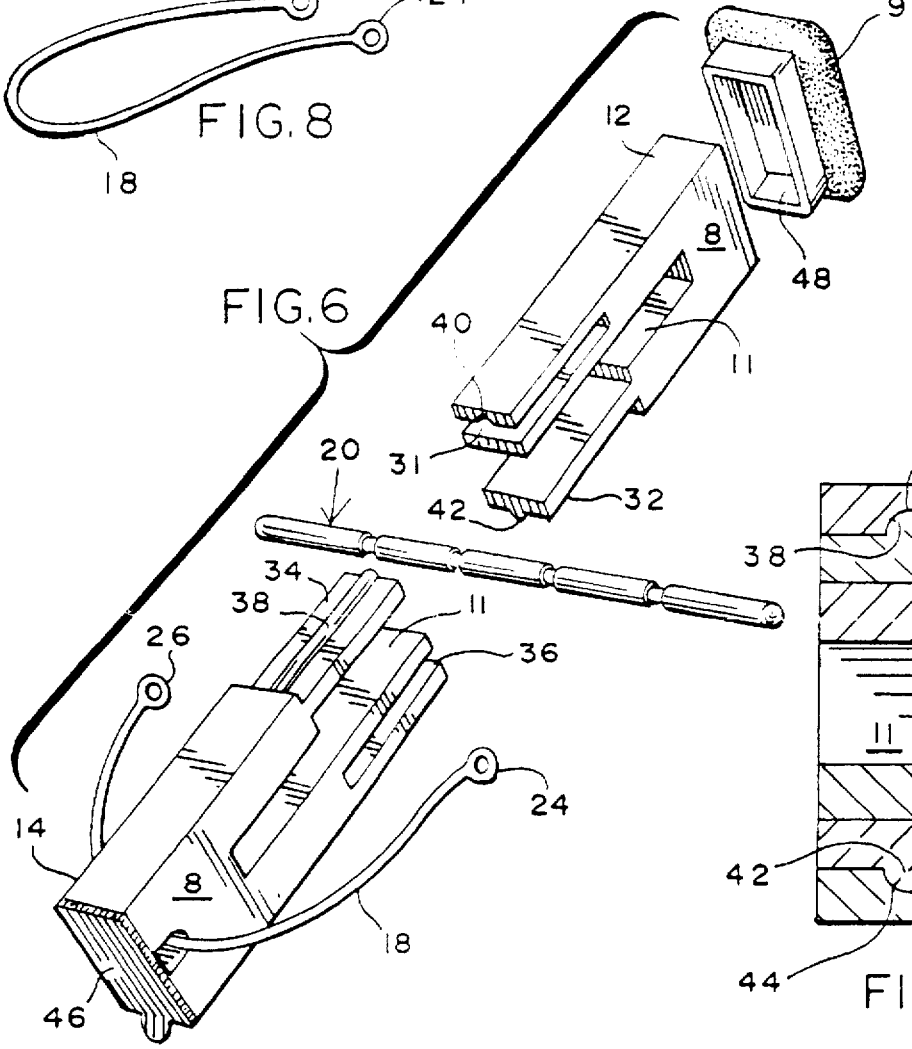
FIG. 6 is a perspective side view, showing the assembly of the two components of the exercise device of this invention.
Figure 9:
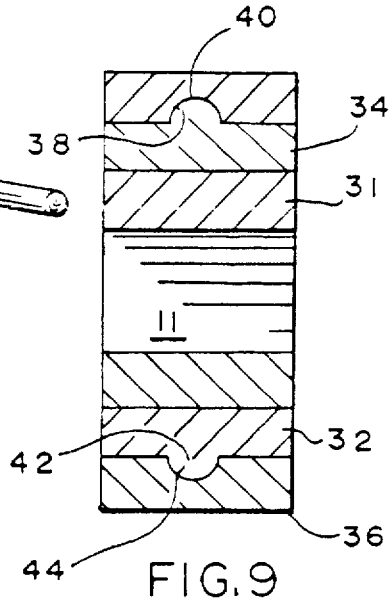
FIG. 9 is a cross section through line 9—9 of FIG. 2.

The assembly of the component parts of the exercise device of this invention is illustrated in FIG. 6 wherein it can be seen that segments 6 and 8 of main body section 4 are adapted to slide onto each other.

Segment 8 incorporates a female dovetail 31 and a male dovetail 32. Segment 6 incorporates a male dovetail 34 and a female dovetail 36. Composite dovetails 31 and 34, and 32 and 36 are keyed in order that segments 6 and 8 will maintain their alignment when assembled. In this regard male dovetail 34 incorporates a male key 38 which meshes with female keyway 40 of female dovetail 31. Conversly male dovetail 32 incorporates a male key 42 which meshes with a female keyway 44 which is integral with female dovetail 36. Once dovetails 31 and 34, and 32 and 36 are inserted in each other component parts 6 and 8 are secured together to form main body section 4.

As can be seen the above described dovetail pairs are spaced apart. This spacing forms an integral slot 11 when segments 6 and 8 are positioned together. Limb 10 can then be readily inserted into slot 11.

Further in the assembly procedure elastic band 18 is inserted into groove 16 in one end of main body section 4. Elastic band 18 is secured in groove 16 via a band 46 one end of which is secured on one side of groove 16 the other side being detachabily secured to the other side of groove 16 via a hook and loop fastener.

Cushion 9 incorporates a female aperture 48 which is adapted to engage the other end of main body section 4.

Once elastic band 18 is secured in groove 16 loop ends 24 and 26 are positioned over limb 10 and secured in grooves 28 and 30. Hook and loop strap 46 is then positioned across the mouth of groove 16 thereby securing elastic band 18 in groove 16.

Utilization of portable exercise device 2 is illustrated in FIG. 1 wherein it can be seen that cushion 9 is placed against the midriff of a user. With his hands the user then grasps the opposing terminal ends of limb 10. The movement of limb 10 towards the users midriff is limited by elastic band 18. The movement of limb 10 towards the user stretches elastic band 18 providing exercise for the user.

As can be best seen in FIG. 7 limb 10 is provided with a second set of grooves 50 and 52 Grooves 50 and 52 stabalize the movement of limb 10 in groove 11.

In the preferred embodiment of this invention all of the component parts of the subject invention are formed from a thermoplastic polymer with the exception of elastic band 18

From FIG. 6 wherein it can be seen that limb 10 can be easily removed from slot 11. Further elastic band 18 can be readily removed from body section 4 and limb 10. Hence these parts can be readily disassembled and stored.

As to body section 4 cushion member 9 can be easily removed from body section 4 and stored.

The largest component of portable exercise device 2 is body section 4. In order to minimize the space occupied by exercise device 2 when disassembled main body section 4 is formed from two segments 6 and 8 which can be readily disassembled from each other. The assembly and disassembly of body section 4 is discussed in detail herein above.

The above description and drawing are illustrative only, modification can be readily made without departing from the present invention, the scope of the subject invention which is limited only by the following claims.

What is claimed is:

1. A portable exercise device which comprises:

a. a two segment main body section having a first terminal end and a second terminal end;

b. a cushion which is detachably attached to the first terminal end of the main body section;

c. a limb which is positioned in a slot which is integral with said main body section;

d. a elastic band the mid section of which is attached to the second terminal end of said main body section the terminal ends of said elastic band being attached to opposite sides of said limb outboard of said main body section.

2. The portable exercise device of claim 1 wherein the segments of said two piece main body section are joined together by an opposing tongues and grooves which are centrally disposed on the length of said main body section.

3. The portable exercise device of claim 2 wherein the two sets of tongues and grooves are utilized to secure the pieces of the main body section together.

4. The portable exercise device of claim 3 wherein a set of tongue and grooves are located on opposite sides of said slot.

5. The portable exercise device of claim 1 wherein said slot is partially located on each segment of said main body section.

6. The portable exercise device of claim 2 wherein said slot is partially located on each segment of said main body section.

7. The portable exercise device of claim 3 wherein said slot is partially located on each segment of said main body section.

8. The portable exercise device of claim 5 wherein said slot is partially located on each segment of said main body section.

9. The portable device of claim 1 wherein the mid section of said elastic band is secured in a groove which is integral with the second terminal end of said main body section and further wherein the terminal ends of said elastic band are formed into loops which in turn are positioned over opposite sides of said limb.

10. The portable exercise device of claim 3 wherein the mid section of said elastic band is secured in a groove which is integral with the second terminal end of said main body section and further wherein the terminal ends of said elastic band are formed into loops which in turn are positioned over opposite sides of said limb.

11. The portable exercise device of claim 5 wherein the mid section of said elastic band is secured in a groove which is integral with the second terminal end of said main body section and further wherein the terminal ends of said elastic band are formed into loops which in turn are positioned over opposite sides of said limb.

12. The portable exercise of claim 6 wherein the mid section of said elastic band is secured in a groove which is integral with the second terminal end of said main body section and further wherein the terminal ends of said elastic band are formed into loops which in turn are positioned over opposite sides of said limb.

13. The portable exercise device of claim 2 wherein the tongue and grooves are keyed.

14. The portable exercise device of claim 3 wherein the tongue and grooves are keyed.

15. The portable exercise device of claim 5 wherein the tongue and grooves are keyed.

16. The portable exercise device of claim 7 wherein the tongue and grooves are keyed.

17. The portable exercise device of claim 11 wherein the tongue and grooves are keyed.

18. The portable exercise device of claim 12 wherein the tongue and grooves are keyed.

19. The portable exercise device of claim 13 wherein the tongue and grooves are keyed.

* * * * *